United States Patent [19]

Köppen

[11] Patent Number: 4,803,960

[45] Date of Patent: Feb. 14, 1989

[54] INTERNAL COMBUSTION ENGINE, PARTICULARLY, A FREE-PISTON ENGINE

[76] Inventor: Detlef Köppen, Rotwandstrasse 3, D-8023 Pullach, Fed. Rep. of Germany

[21] Appl. No.: 56,425

[22] Filed: Jun. 1, 1987

[51] Int. Cl.[4] ..... F02B 71/00

[52] U.S. Cl. ..... 123/46 A; 60/595

[58] Field of Search ..... 123/46 R, 46 A, 47 R; 60/595

[56] References Cited

U.S. PATENT DOCUMENTS

| | | | |
|---|---|---|---|
| 1,776,895 | 9/1930 | Ferguson . | |
| 3,853,100 | 12/1974 | Braun | 123/46 R |
| 4,308,720 | 1/1982 | Brandstadter | 123/46 R |
| 4,344,288 | 8/1982 | Heaton | 123/46 R |
| 4,561,252 | 12/1985 | David | 123/46 A |

FOREIGN PATENT DOCUMENTS

| | | | |
|---|---|---|---|
| 1140017 | 11/1962 | Fed. Rep. of Germany . | |
| 3038673 | 5/1982 | Fed. Rep. of Germany . | |
| 3149930 | 8/1982 | Fed. Rep. of Germany | 123/65 A |
| 8513339 | 2/1986 | Fed. Rep. of Germany . | |
| 1206179 | 2/1960 | France | 123/46 A |

*Primary Examiner*—Charles J. Myhre
*Assistant Examiner*—David A. Okonsky
*Attorney, Agent, or Firm*—Helfgott & Karas

[57] ABSTRACT

An internal combustion engine comprises a cylinder and a piston axially movable within the cylinder and formed with cylindrical projections extending axially outwardly from the piston and being of a smaller diameter than that of the piston. The piston and its projections are formed with ducts which are connectable with inlet ports formed in the wall of the cylinder for admitting air and/or air/fuel mixture into combustion chambers of the engine and outlet ports for expelling exhaust gases from the combustion chambers, upon the movement of the piston. The ducts are formed one each within one of two longitudinal piston halves. The inlet ports, outlet ports and ducts are assigned to two longitudinal halves of the piston and its projections and arranged in the engine so that the admission of air and/or air/fuel mixture into the combustion chambers and the removal of exhaust gases therefrom via short, low-turbulence paths are controlled only by the position of the piston and its projections within the cylinder.

33 Claims, 3 Drawing Sheets

INTERNAL COMBUSTION ENGINE, PARTICULARLY, A FREE-PISTON ENGINE

This invention relates to an internal combustion engine and, more specifically, to a free-piston engine. Internal combustion engines have pistons guided within cylinders, which pistons, together with said cylinders, define combustion chambers within which a fuel/air mixture will be ignited. For driving purposes, the kinetic energy of said pistons will be transferred, e.g. by mechanical means or, with free-piston engines, more specifically by way of pneumatic, but preferably by way of hydraulic media.

An internal combustion engine of said type is known from German Pat. No. 286,806. With said known internal combustion engine, both front faces of the piston projections comprise compression chambers intended to compress the charge air prior to combustion. Into said compression chambers, air will flow through corresponding radial ports through the cylinder wall in the area of said piston projections at both cylinder ends, it being necessary to control said radial inlet ports via separate piston slide valves. Precompressed air will flow through radial bores provided in, and controlled by, such piston projections into the hollow piston, through ducts towards the opposite piston projection and thence via the corresponding radial bores provided in said piston projection into the appropriate combustion chamber. During piston return travel, the direction of air flow through the piston will change. Exhaust gases will leave, under piston face control, the combustion chambers via outlet ports arranged in the radial symmetry plane of the cylinder. Said known internal combustion engine will transfer its power mechanically, via a piston rod, towards the outside; to such extent, it is not really a free-piston engine.

Said known engine suffers, among other things, from the drawback that for inlet control purposes separate piston slide valves will be required, over and above said radical bores provided in the piston projections. Operation and control of this engine is complicated and highly unreliable, gas flow paths through the entire piston are long, complicated and subject to high losses, the substantial expansion occurring within the hollow piston causing, to a large extent, the loss of the relatively high, and highly power-consuming, degree of precompression achieved previously. Charge cycles associated with any piston travel, combustion chamber filling, and fuel/air mixing actions invariably are low-efficiency, elaborate and complicated processes.

As opposed to this, the object of the invention is to improve a similarly structured internal combustion engine and, more specifically, a free-piston engine so that control and operation become less complicated, more versatile, more efficient and more reliable, while power transfer will be achieved in a particularly cost-efficient manner.

Above all, such measures will cause the admission of air, or of the air/fuel mixture, into the combustion chambers as well as the removal of exhaust gases therefrom to proceed via short, low-turbulence paths in a low-loss manner, controlled only by the position of the piston and of its two cylindrical projections in a particularly reliable as well as simple way. Therefore, the piston and its two cylindrical projections are suitably dimensioned, and ducts and bores are assigned, separately and jointly, to one half of the overall piston length as well as to the inlet ports located only at the center of the cylinder, and to the cylinder outlet ports arranged on either side of said inlet ports.

Depending upon piston position, said inlet ports together with such bores and ducts will form a permanently open connection or will be linked to, or blocked as regards, one half of said piston while the outlet ports assigned to said half of such piston will be blocked or open. Thus, air or a fuel/air mixture will flow in a low-loss manner along a short path through said ducts and bores into the combustion chambers and therein follow short paths along the walls of said combustion chambers. In the process, practically all of the exhaust gases present within the combustion chamber will be pushed out of them so that rapid, optimal filling/exhaust action will result for the combustion chambers. In order to achieve a fuel/air mixture as homogenous as possible within the combustion chambers and to obtain a rapid and satisfactory filling/exhaust cycle, a preferential development of the invention consists in arranging, according to the invention, such ducts within said cylindrical projections so that their orifices are located in a ring-like arrangement on the lateral surfaces of said cylindrical projections; injection nozzles and/or spark electrodes, likewise provided in a ring-like arrangement, end in toroid-like recesses coaxial with respect to said cylindrical projections and located within the faces of said combustion chambers. These measures will ensure optimum flushing of exhaust gases out of the combustion chambers by the air or the fuel/air mixture entering thereinto, and obtain satisfactory charging, mixing and combustion, and cause piston movement in a particularly expedient and efficient manner, thus enhancing the drive power achievable from such engine.

Simultaneously, thanks to the toroid-like configuration of said combustion chambers, it is now possible to define, by engineering means, to a higher degree of precision the minimum chamber volume (clearance volume) and the maximum compression ratio of the fuel/air mixture as well as the course of its combustion and the useful effects obtainable therefrom. According to the invention, displacement transducers sensing the precise position of the piston so as to permit determining and controlling optimum fuel injection and/or ignition timing are located within the cylinder walls. This link between piston position sensing, more particularly in free-piston engines, and starting the combustion process will ensure particularly reliable engine function and high engine efficiency.

Said displacement transducers might for instance be magnetic-field sensors operating inductively and generating, thanks to piston movements, an inductive voltage depending upon piston position.

German patent application No. 1,480,100, laid open for opposition, discloses a free-piston ignition engine. Said engine has no ducts of any description within its piston; moreover, its inlet ports are outside the radial symmetry plane of the cylinder and have to be controlled, just as the outlet ducts, via the piston faces. Since, in this known instance, gas inflows into, and outflows from, the corresponding combustion chamber are not directed concentrically and radially outwards from the axis, and since the inflow has to be directed towards, and the outflow away from, the cylinder axis, and since, moreover, inflows and outflows will proceed at opposite ends of any combustion chamber in the same radial plane, resulting flow conditions are highly unsatisfactory, just as the filling and exhaust cycles, all of which leads to unreliable, high-loss and thus inefficient operation. Moreover, controlling both the inlet and outlet processes with a single, joint piston edge will lead, with this configuration of inlet and outlet ports, to low-reliability control action and engine operation.

German patent application No. 1,480,100, laid open for opposition, provides for kinetic energy to be transferred from the piston of the free-piston combustion engine to a hydraulic fluid in order to drive hydraulic-power motors, for instance in vehicles; this design principle will permit pumps to be configured for any type of actuating or delivery media.

Printed German patent specification No. 3,029,287 discloses a piston rod bearing a piston on either face as well as a third piston located centrally between said pistons on such piston rod. With respect to the cylinder, the two outer pistons define one combustion chamber each, while the central piston delimits, with respect to the cylinder, two chambers permitting a fuel/air mixture to be precompressed prior to being fed into, and ignited within, said combustion chambers via overflow ducts.

Another known arrangement (from U.S. Pat. No. 4,449,488 and published German patent specification No. 2,816,660) is to provide, within a piston defining, together with the cylinder, certain combustion chambers, a second piston to form chambers for precompression of air.

In general, air or else a fuel/air mixture can be fed into any such combustion chamber. In the first case, fuel will be injected subsequently into said combustion chambers. Generally speaking, spark electrodes may be located within said combustion chambers, or the compression ratio obtainable within them can be chosen high enough to cause spontaneous ignition of a fuel/air mixture. Liquid, gaseous or even solid fuels may be used, such as gasoline, diesel oil, heavy oil, light fractions, coal dust, etc. Further free-piston engines are known (from U.S. Pat. No. 4,205,528) to have a piston guided within a cylinder, said cylinder defining, together with the piston faces, combustion chambers, while the piston faces comprise projections and the combustion chambers nozzles permitting fuel to be injected, the cylinder wall having air inlet ports and exhaust gas outlet ports blocked or released by the piston depending upon its position. Said projections located on the piston faces have the shape of truncated cones; they guide the air being fed into the combustion chambers so as to flush exhaust gases from such combustion chambers whenever any compression stroke is initiated. With all engines mentioned, and more particularly with said free-piston engines, substantial design and/or engineering efforts are required if introducing air and fuel into the combustion chambers is to be controlled as a function of piston position. Said known control systems often suffer from low reliability. Flow paths leading to and from combustion chambers are frequently long, cause turbulence and entail losses. This is why said known engines are, in practice, subject to frequent failures despite their sophisticated design, and place a high maintenance load on their operators. Finally, the efficiency of such engines tends to be insatisfactory in practical use.

One embodiment of the invention is characterized by having the fuel injection nozzles and/or the spark electrodes located in an arrangement similar to a ring within the cylinder wall of the combustion chamber placed opposite to and facing the piston end faces. This measure contributes to forming, within the combustion chambers, a fuel/air mixture as homogeneous as possible and to ignite and to burn it in a manner as expedient and as efficient as possible. In a further embodiment of the invention, the engine according to the invention is fitted with a device designed to compress air or a fuel-/air mixture, which device is arranged either within the cylinder itself or external to it. In the last-mentioned instance, a charge air accumulator will be associated with said compression device. External compression of air can be performed according to the turbocharger principle; however, common pump types may likewise be used for compression purposes. In another embodiment of the invention, the internal combustion engine according to the invention is designed to be used within a system operated by a pressure fluid and switchable between engine and pump operation, such as a hydraulic unit, and coupled with a dynamo used as a motor while the internal combustion engine is being started. This will provide starting means for the internal combustion engine. While starting is proceeding, the dynamo will be supplied with power via an accumulator to drive the system, for instance a hydraulic unit, now operating as a pump so that the internal combustion engine which, at the faces of its piston projections, is subject to the action of said pressure fluid, will be started. As soon as the internal combustion engine has been started, the system operated by a pressure fluid will act as an engine driving, for instance, a hydraulic unit; among other things, the dynamo will now be driven and charge, in its turn, the battery. Moreover, the system operated by the pressure fluid comprises an engine or motor driven by said pressure fluid, which engine or motor will absorb the drive power developed by the internal combustion engine via said pressure fluid and convert said drive power into effective work. With another embodiment of the invention, the inlet-port axes of the internal combustion engine provided to admit air or a fuel/air mixture are located within the cylinder wall so as to superimpose, upon the axial movement of the piston, a rotary movement of said piston around its longitudinal axis. Said measure will prevent, among other things, the piston from producing excessive running-in marks. Essential, non-obvious developments of the internal combustion engine according to the invention relate to the geometrical configuration of said cylindrical piston projections, which configurations deviate from the continuously smooth cylindrical outer surface of projections having constant, uniform diameters. We claim, for instance, piston projections featuring adjoining cylindrical longitudinal sections, each having a differing diameter, all guided movably within the cylinder by suitable axial bores of appropriate diameters, the faces of the cylindrical longitudinal sections of the piston projections causing them to become variablevolume chambers owing to the alternating piston movements occurring within the engine during combustion, within wich chambers the pressure of some fluid may be increased.

Our claims extend, for instance, to embodiments of said cylindrical projections which have on one side—and pursuant to another development, on both sides—of a larger-diameter longitudinal section acting as a diskshaped, at least one further cylindrical longitudinal section the diameter of which is inferior to the diameter of the piston.

Both the free end faces of said projections and the faces of said longitudinal sections of such projections will perform travelling movements during any stroke of the piston while being radially sealed with respect to the corresponding bores within the cylinder, all without having the cylinder ends come into contact with the corresponding piston ends facing them within the cylinder. Depending upon the embodiment claimed and the inlet and outlet flow paths associated therewith, such travelling movements of the end faces of said projections serve to compress some fluid, such as a gas or a hydraulic fluid actuating a system operated by a pressure fluid, and/or the gas or the fuel/air mixture to be ignited within the internal combustion engine.

Thus, the longitudinal sections of said piston projections will create, for instance, a double-capacity or two-stage compressor for the internal combustion engine, which compressor will render a separate turbocharger superfluous. Over and above that, a pressure fluid pump will be formed, which pump will be configured as a reciprocating pump (for instance a one-stage pump having two alternatingly pressurized or delivering chambers, or a two-stage one) to be linked to a downstream system actuating by a pressure fluid, for which system the internal combustion engine will develop its power, particularly if designed as a free-piston engine.

Within the inlet and outlet ducts of said variable-volume chambers, there will be suitable control valves—such as non-return valves, or pressure-controlled slide valves, or externally controlled regulating valves—to ensure reliable operating of the piston-swept volumes.

Between the chambers designed to compress the combustion air or the fuel/air mixture, and the inlet ducts of the internal combustion engine located within the radial symmetry plane of the cylinder, open or closed-loop control valves may be provided, which valves will then control the filling ratio of the combustion chamber.

Pursuant to a non-obvious development of the invention, the pressure medium of the system operated by it will be used to cool the cylinder, preferably in the area of the combustion engine, while being admitted through the suction duct to the variable-volume cylinder chamber acting as a pump.

Finally, the internal combustion engine may be designed to be used as a free-piston engine, or else combined with a mechanical drive articulated with respect to the piston or its projections.

With the solution in accordance with claim 34, preferably precompressed inlet gas destined to be burned is kept continuously available within the hollow piston invariably refilled so that it can flow directly into the combustion chambers whenever the bores provided within the lateral surfaces of the projections are opened.

Two embodiments of the object of this invention as well as a block diagram showing a system according to the invention are shown on, and will now be explained with reference to, the drawing wherein.

Figure 3:
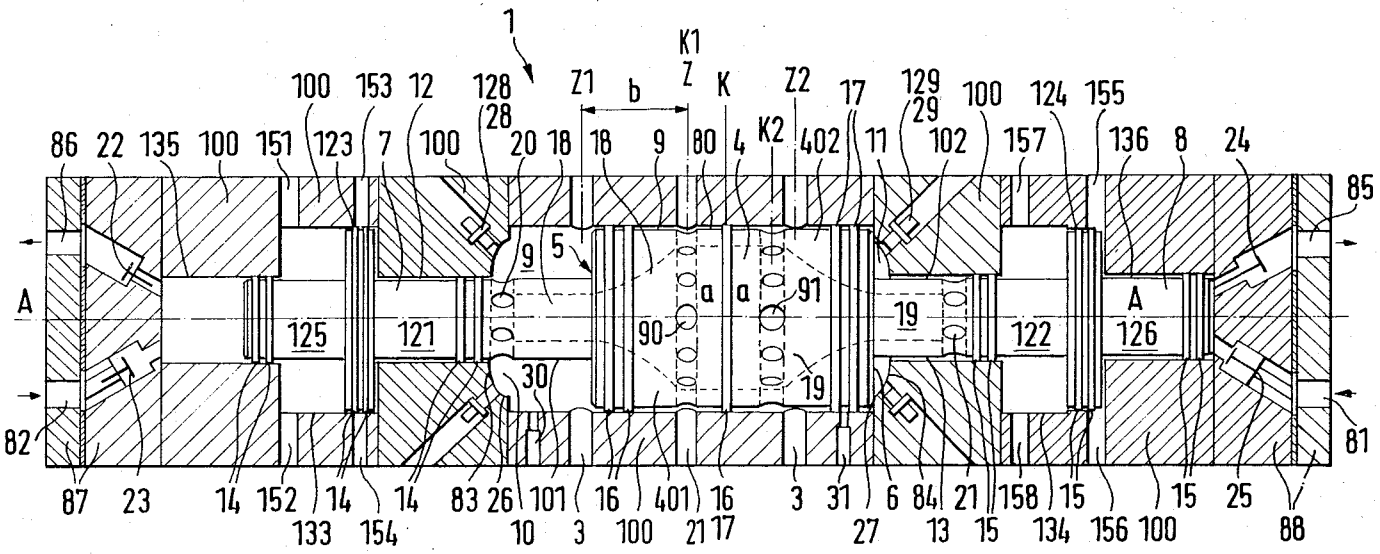
Figure 4:
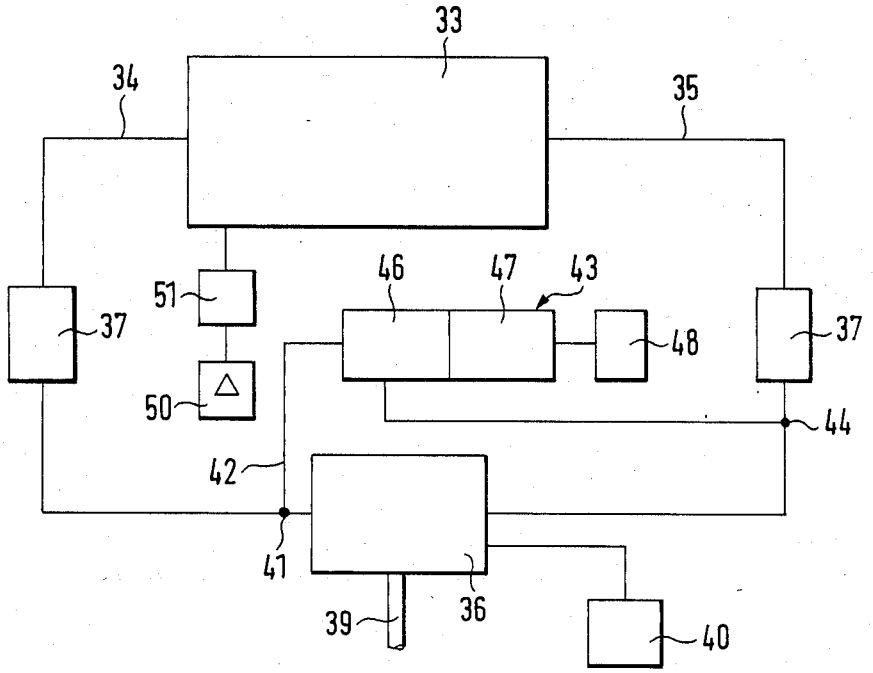

FIG. 3 shows a sectional view of another embodiment of the internal combustion engine according to the invention configured as a free-piston engine having an integrated compressor providing twice the filling volume, and an integrated pressure fluid pump designed for hydraulic media and used to transfer the power delivered by the engine; and FIG. 4 shows a block diagram of how to use an engine according to the invention in connection with a system operated via a pressure fluid and fitted with a starting device for the internal combustion engine.

Figure 1:
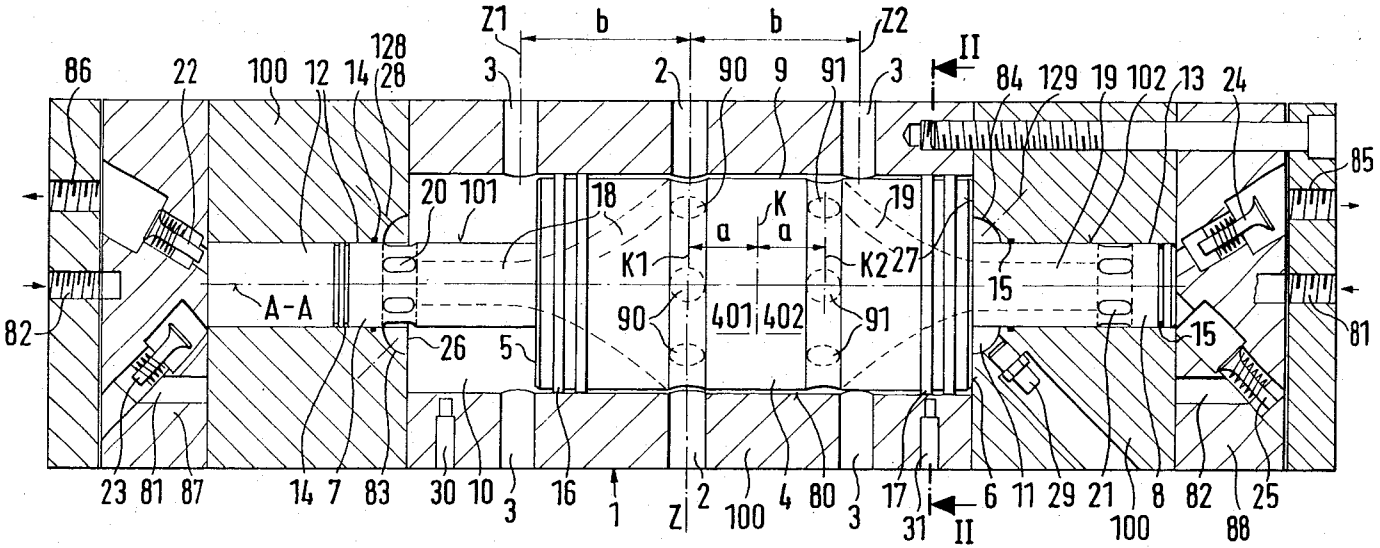
FIG. 1 shows a sectional view of an embodiment of the internal combustion engine according to the invention configured as a free-piston engine without integrated compressor but with a pressure fluid pump suitable for hydraulic media integrated into one end of the engine, which medium is used to cool the cylinder on the intake side of the pump.

The internal combustion engine in accordance with the embodiment of the invention as per FIG. 1 consists of a cylinder 1 within which a piston 4 can reciprocate over the distance defined by its stroke while being radially sealed with respect to the axially extending cylinder bore supporting it. Together with its end faces 26, 27, said cylinder bore forms cylinder chamber 9. At each of its ends, the piston is designed to have one face, designated 5 and 6, respectively. At either side of piston 4, there extend, away from faces 5 and 6, and coaxially with respect to piston 4, cylindrical projections 7, 8 having uniform diameters inferior to the one defining piston 4. The ends of said projections 7, 8 are guided movably and in a radially sealed manner, within further axial cylinder bores 12, 13, which bores extend away from cylinder chamber 9, prolonging it, at a diameter approximately equal to the one defining projections 7, 8 within cylinder 1; at their ends, said bores are closed by one lateral face each, designated 87 or 88 respectively. Within radial symmetry plane Z of said cylinder, there are inlet ports 2 within longitudinal cylinder wall 100, which ports lead radially into cylinder chamber 9 and are used to supply air or the fuel/air mixture required for burning within combustion chambers 10, 11 of said engine. At either side of such inlet ports 2, outlet ports 3 passing through longitudinal cylinder wall 100 are arranged at distances b and likewise within either one radial plane Z1, Z2 of said cylinder. The axis of inlet ports 2 may be spaced with respect to the longitudinal cylinder axis A-A such as to have piston 4 rotated by the inflowing gas around its longitudinal axis A—A. At its cylindrical (outer) surface 80, piston 4 is provided with radial orifices 90, 91 ending at ducts 18, 19 within piston 4, said orifices 90, 91 being arranged in radial planes K1, K2 of piston 4 located at distances at either side of radial plane K of said piston 4. Within piston 4, ducts 18, 19 lead, preferably so as to maintain a nearly constant flow cross-section, as individual ducts hollowing out piston 4, or as bundled ducts, from orifices 90, 91 into projections 7, 8 of piston 4, where they once more lead into bores 20, 21 preferably distributed in a ring-shaped arrangement around the periphery of projection 7 or 8, respectively, and, located in one radial plane each, pass through the cylindrical outer surfaces 101, 102 of such projections 7, 8 into said projections, for instance in a radial direction. Thus, a flow path connection is attributed to either of the two longitudinal halves 401, 402 of the piston which connection leads from orifices 90, 91—preferentially likewise located in a ring-shaped arrangement at the periphery of the body of piston 4—through ducts 18, 19 assigned separately to either longitudinal half 401, 402 and to either projection 7, 8, which ducts are located within piston 4 and its projections 7, 8 and lead up to bores 20, 21, all of them intended for the admission and the passage of air or of a fuel/air mixture for combustion purposes, starting at ports 2 in longitudinal cylinder wall 100 and leading into the combustion chambers 10, 11 located axially to either side of piston 4 within cylinder chamber 9.

Piston 4 may, along its lateral surface and within radial planes K1 and K2, and/or longitudinal cylinder wall 100 may, along the interior surface area of cylinder chamber 9 and within radial symmetry plane Z, be peripherally provided with a flow duct which may be configured, by way of example, as a, for instance all-around, groove-like cavity permitting the establishment of a flow path connection distributed over the entire periphery between individual inlet ports 2 located in a ringshaped arrangement and/or orifices 90, 91 located, in a ring-shaped arrangement, on the lateral face of the piston, a feature that may be important if piston 4 is to rotate around its axis A-A, specifically if configured as a free piston.

Piston 4 is sealed radially and preferably at its ends, if necessary, however, also between planes K1 and K2, via sealing means such as piston rings and/or annular seals located between its peripheral surface, i.e. its lateral surface and the axial cylinder bores forming cylinder chamber 9. At their ends, i.e. between the radial planes comprising bores 20, 21 and their free end faces within said cylinder bores 12, 13, such cylindrical projections 7, 8 are likewise sealed by means of sealing means 14, 15 such as annular seals relative to cylinder 1, so as to prevent any axial flow path from being formed between the corresponding free end faces of projections 7, 8 and combustion chambers 10, 11. Within the ends of cylinder chamber 9 facing piston 4, i.e. within the interior end faces 26, 27 of cylinder 1, toroid-like recesses 83, 84 are provided, both preferably coaxial with respect to cylinder axis A—A, around projections 7, 8 and/or cylinder bores 12, 13, into which toroid-like recesses 83, 84 injection nozzles 28, 29 and/or spark electrodes 128, 129 project and/or act which are located, preferably in a ring-shaped arrangement on the periphery of cylinder 1, within said toroid-like recesses 83, 84 determining approximately the clearance volume of combustion chambers 10, 11 at their maximum compression ratios.

Dimensions as well as length and distance attributes are chosen so as to have coincide the approximately radial planes Z and K1 whenever piston 4 approaches, with face 6 of one of its piston halves 401, face 27 of cylinder 1 turned towards it, thus creating an open path between the inlet ports and orifice 90 of the other piston half 401 so as to link, by way of an open flow duct, inlet ports 2 with duct 18 associated with said other longitudinal half 401, and via bores 20 in projection 7 directly with combustion chamber 10 so as to permit the gas to be ignited to flow thereinto. For this purpose, bores 20 are spaced at a certain distance away from face 5 of the piston (just as bores 21 with respect its face 6), and the axial length of cylinder chamber 9, of piston 4, of combustion chambers 10, 11, and of projections 7, 8 as well as the maximum distance separating faces 5 and 26 or 6 and 27 are chosen so as to have bores 20, 21 open within cylinder chamber 9 or within combustion chambers 10, 11 whenever piston 4 is near its opposite clearance position, i.e. near face 27 or 26, as the case may be. Owing to the largely symmetrical arrangement of surfaces, chambers, ducts, bores, distances etc. with respect to radial symmetry plane Z of cylinder 1 and to radial symmetry plane K of piston 4, the above definition is just as true for the dimensions characterizing the other travelling directions of piston 4.

Likewise near the dead-center positions of piston 4 are the open flow path connections between inlet ports 2 and the corresponding combustion chamber 10 or 11, as well as outlet ports 3 located in common radial planes Z1 or Z2. In these top or bottom dead-center positions of the piston, the outlet ports 3 corresponding to radial planes 21 or 22 will be opened by one of the faces 5 or 6 of piston 4 with respect to the appropriate combustion chamber 10 or 11 so as to permit exhaust gases to leave combustion chamber 10 or 11, i.e. to be flushed out of combustion chamber 10 or 11 by the fresh gas fed in via inlet ports 2.

For the purpose of engine control, particularly necessary if piston 4 is configured as a free piston, displacement transducers 30, 31 will be arranged within the wall of cylinder 1, for example near the ends of cylinder chamber 9, so as to capture the various in-travel positions of piston 4; the various piston position signals may be used and will serve to activate, at the proper time, injection nozzles 28, 29 or spark electrodes 128, 129.

Further away from the two dead-center positions and towards the intermediate piston position, i.e. in the direction of diminishing distances between radial symmetry planes Z and K, the flow path connection between inlet ports 2 and orifices 90, 91 through piston 4 itself is blocked, just as are the flow paths leading from bores 20, 21 to combustion chambers 10, 11, via the sealed lateral surfaces of projections 7, 8 on the one hand and cylinder bores 12, 13 on the other hand, as are the flow paths leading from combustion chambers 10, 11 to outlet ports 3 via end faces 5, 6 and the sealed lateral surfaces of piston 4.

The cylinder ends are provided with faces 87, 88, which faces close said axial cylinder bores 12, 13 within which the free ends of projections 7, 8 move as the piston reciprocates so that, within said cylinder bores 12, 13, a variable-volume chamber is created between end faces 87, 88 formed by cylinder 1 and the end faces of the free ends of said projections 7, 8, which chambers are used to pump a pressure fluid, any such variable-volume chamber acting, as its volume decreases as a function of piston advance, to increase the pressure exerted on the medium located within said variable-volume chamber.

Said end faces 87, 88 comprise pressure fluid ducts 81, 82, 85, 86 leading axially to cylinder bores 12, 13, which ducts serve as inlets on the suction side and as outlets on the delivery side; for the control of said ducts, control valves 22, 23, 24, 25 are therein provided, configured, for instance, as non-return valves, or as pressure-controlled slide valves, or as open or closed-loop control valves triggered externally, for instance electrically.

Finally, pressure fluid ducts 81, 82, respectively located on the suction side, lead from the opposite end of the cylinder and its end faces 87, 88 via pressure fluid ducts 81, 82 provided within longitudinal cylinder wall 100 and designed to have as large a surface (cross-sectional extent) as possible with respect to said cylinder wall, for instance through separate ducts parallel to pressure-fluid ducts 81, 82 on the suction side, towards the then other face located at the other end of the cylinder, and thence via the suction-side control (i.e. inlet) valve axially into the end faces of cylinder bores 12, 13. This arrangement is intended to cool, by means of the pressure fluid admitted on the suction side, cylinder 1, preferentially in the area of longitudinal cylinder wall 100 in the longitudinal area surrounding cylinder chamber 9, and thus the internal combustion engine.

In summary, FIG. 1 shows an embodiment of a free-piston engine according to the invention. The wall of cylinder 1 comprises air inlet ports 2 and exhaust-gas outlet ports 3; moreover, it guides axially movable piston 4. Said inlet ports 2 are arranged in one, and said outlet ports in two, annular zones. Piston 4 has, on its end faces 5, 6 one cylindrical projection each (7, 8), the diameter of which is inferior to the diameter of piston 4. Said piston is guided within a cylinder chamber 9 subdivided by it into combustion chambers 10, 11. In all their positions, said cylindrical projections 7, 8 are within cylinder bores 12, 13 which may, as can be seen from the block diagram shown in FIG. 4, lead to a hydraulic motor, for instance via hydraulic lines.

Via their end faces, said cylindrical projections 7,8 are in contact with any hydraulic fluid present within said lines. Cylindrical projections 7, 8 are provided with seals 14, 15 so as to be sealed off against any such hydraulic fluid. Piston 4 may likewise be provided with seals 16, 17 in order to seal off combustion chambers 10, 11. Moreover, piston 4 features ducts 18, 19 starting at its side faces and ending at bores 20, 21 of cylindrical projections 7, 8. Depending upon the type of engine, said ducts are separate, or open with respect to each other. Bores 20, 21 end at the lateral faces of said cylindrical projections 7, 8. The ends of ducts 18, 19 on the lateral faces of piston 4, where they form orifices 90, 91, will be located, according to one solution in two zones K1, K2, and according to the other solution in one zone surrounding the axially central area of piston 4 in an arrangement that is equidistant, i.e. similar to a ring. Said ring-shaped arrangement has likewise been chosen for the orifices of bores 20, 21, located within annular zones of cylindrical projections 7,8. Said combustion chambers 10, 11 are provided, coaxially with respect to said cylindrical projections 7, 8 and opposite to end faces 5, 6 of piston 4, with one toroidlike recess in both end faces 26 and 27 of cylinder chamber 9, within which recesses fuel injection nozzles 28, 29 are located, likewise in a ring-like arrangement. By way of displacement transducers 30, 31, magnetic field sensors are arranged within the wall of cylinder 1 in the areas defined by combustion chambers 10, 11 the function of which transducers is to control the injection nozzles 28, 29 and/or the additional or alternative ignition devices (spark electrodes 128, 129) as a function of the position attained by piston 4. The internal combustion engine according to the invention and, more specifically, the free-piston engine to FIG. 1 function as follows:

Either air or a fuel/air mixture is fed into the combustion chambers 10, 11 via ducts 18, 19 and bores 20, 21 of piston 4 and its cylindrical projections 7, 8. In the first case, nozzles 28, 29 are used to inject fuel, resulting in auto-ignition, or else ignition is obtained by means of spark electrodes. In the position of piston 4 shown by FIG. 1, air or a fuel/air mixture is compressed, within combustion chamber 11, to the volume corresponding to said toroid-shaped recess 84 provided in face 27. The other combustion chamber, 10, contains exhaust gases leaving via outlet ports 3 provided within the wall of cylinder 1. Said ducts 18 of piston 4 form an open flow path connected to inlet ports 2 of said cylinder so that, for instance, precompressed air or a compressed fuel/air mixture may flow, via ducts 18 and bores 20, into combustion chamber 10, flushing out, in the process, the exhaust gases present within such combustion chamber 10.

From its right-hand position shown in FIG. 1, piston 4 will be driven leftwards upon ignition.

This movement of piston 4 will block outlet ports 3 and, according to the solution proposed by claim 1, even inlet ports 2 within the wall of cylinder 1 by the lateral surface of the piston, causing the precompressed air or fuel/air mixture within combustion chamber 10 to be further compressed. The orifices of ducts 18 and bores 20 will likewise be blocked by this piston movement.

As soon as the piston has reached a predetermined stroke position, magnetic field sensor 30 will send a control signal to the system controlling the injection nozzles 28, causing it to inject fuel, or to ignition system 128, causing it to ignite the fuel/air mixture.

As soon as piston 4 has reached its other limit position, at left in FIG. 1, the conditions prevailing in combustion chamber 10 correspond to the conditions shown on FIG. 1 for combustion chamber 11. The piston describes a reciprocating movement transferred to the hydraulic medium present within the variable-volume chambers of cylinder bores 12, 13, thus permitting a hydraulic motor or a turbine to be driven. FIG. 4 shows a block diagram of a system operated by some pressure fluid to be used with, and linked up to, the internal combustion engine in accordance with the invention, preferably configured as a free-piston engine. In FIG. 4, said engine is designated 33. From said engine, hydraulic lines 34 and 35 lead to hydraulic motor 36. Within hydraulic lines 34, 35, a cooling device 37 is arranged. Said hydraulic motor 36 acts upon shaft 39 of a system driving, say, a vehicle such as an automobile. Downstream from, or hierarchically inferior to, hydraulic motor 36, there is a switchable accumulator 40. From hydraulic line 34, a hydraulic line 42 leads from branch 41 to a starter unit 43 linked, via another hydraulic line, to branch 44 of hydraulic line 35. Said starter unit 43 consists of the hydraulic unit 46 that can be switched from motor to pump operation, and of dynamo 47 that can be switched to a generator mode and is operable as a generator, and of battery 48.

Whenever internal combustion engine 33 is being started, dynamo 47 will operate as a motor supplied by battery 48, and drive hydraulic unit 46 switched to pump operation, which unit will crank the internal combustion engine.

Upon starting internal combustion engine 33, preferably as a free-piston engine, said hydraulic unit 46 will switch to its motor mode and drive dynamo 47, which dynamo will, in its generator mode, charge battery 48. If, by way of example, some vehicle such as an automobile is braked down, hydraulic motor 36 will operate as a pump and deliver hydraulic fluid to accumulator 40, thus storing energy that can be resupplied to hydraulic motor 36 during acceleration. Moreover, internal combustion engine 33 comprises a compressor 50 delivering fresh air for combustion purposes, and an accumulator 51 storing precompressed fresh air that can be supplied to combustion chambers 10, 11.

Figure 2:
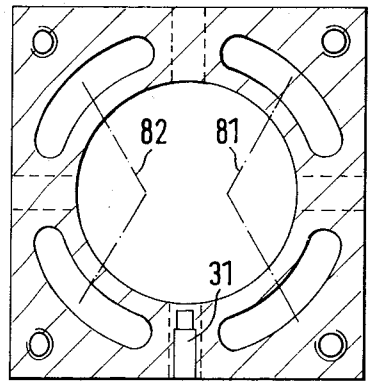
FIG. 2 shows a cross-sectional view of the engine pursuant to FIG. 1, displaying the arrangement of the pressure-medium intake ducts used to cool the cylinder.

FIG. 2 shows a sectional view of the internal combustion engine, preferably a free-piston engine, to FIG. 1, which view demonstrates one possible arrangement and configuration of suction-side, maximized-surface pressure fluid ducts 81, 82 through longitudinal cylinder wall 100.

FIG. 3 shows another embodiment of the internal combustion engine according to the invention, once more a free-piston engine, which engine, as to its central area of cylinder 1, and as to the pressure fluid pumps at the ends of such cylinder, is in accordance with the embodiment shown in FIG. 1 so that the corresponding description as to configuration and function given for FIG. 1 is similarly applicable to the section corresponding to the internal combustion engine within cylinder chamber 9, the environment delimiting said chamber, and the pressure-fluid pumps located in the terminal areas within cylinder bores 135 and 136, instead of bores 12 and 13 as per FIG. 3. Only as regards seals 14, 15 and 16, 17, small differences are shown insofar as projections 7, 8 bear two annular seals located next to each other and as piston 4 bears at least one annular seal in radial plane K between bores 90 and 91.

Between the internal combustion engine in the central area of cylinder 1 comprising piston 4, and the pressure fluid pump located in the terminal areas of cylinder 1 comprising cylinder bores 135 and 136, the free ends of the third longitudinal sections 125, 126 of projections 7, 8, the end faces 87, 88, and valves 22 through 25, all of which correspond as to structure, configuration and function to the embodiment represented in FIG. 1, the embodiment according to FIG. 3 comprises at either side of said internal combustion engine within cylinder chamber 9, a compressor integrated into cylinder 1 permitting fresh gas as well as air for the internal combustion engine to be precompressed as supplied by said integrated compressor via inlet ports 2.

Said compressor is formed by compression stages arranged symmetrically at either side of said cylinder's radial symmetry plane Z and of said piston's radial symmetry plane K. Each of said compressor stages is formed by axial cylinder bores 133, 134 having a diameter superior to the diameter of cylinder bores 12, 13 and 135, 136, as well as an axial length superior to the stroke of piston 4.

In each of said axial cylinder bores 133, 134, one diskshaped piston is guided so as to be axially displaceable, to be sealed with respect to the wall of its bore by sealing means 14, 15, and so as to be reciprocated together with piston 4. Either of said disk-shaped pistons comprises asecond, axially short longitudinal section, 123 or 124, of said projections 7 or 8, the diameter of which sections is superior to the first and third longitudinal sections 121, 122 and 125, 126, which diameter corresponds to the diameter of cylinder bores 133, 134 equal, for instance, to the diameter of piston 4 or to the diameter of cylinder chamber 9.

Said second longitudinal sections 123, 124 of projections 7, 8, forming a flat, disk-shaped piston will now automatically be displaced along with any stroke of piston 4, following the same trajectory over identical distances and without ever touching the ends of cylinder bores 133, 134 whenever the piston reaches a dead-center position. The first and third longitudinal sections 121, 122 and 125, 126, axially adjacent to said second longitudinal sections 123, 124 are all sealed within the corresponding cylinder bores 12, 13 or 135, 136. At either end of said cylinder bores 133, 134, there terminate inlet ports 152, 154, 156, 158, preferably valve-controlled, and outlet ports 151, 153, 155, 157, all of which ports lead radially through the cylinder wall and permit pressureless fresh gas and air for combustion purposes to be fed into said compressor, as well as the delivery of precompressed fresh gas and air from said compressor to inlet ports 2.

By way of example, inlet ports 132, 158 and 154, 156 may be coupled for the purpose of fresh gas supply, just as outlet ports 151, 157 and 153, 155 may be coupled, through which precompressed fresh gas may be fed and guided, possibly under valve control, jointly to said inlet ports 2. The function of said compressor equipment is as follows: Fresh gas and air will be sucked, via possibly valvecontrolled inlet ports 152, 158, into one of the chambers increasing in size within cylinder bores 133, 134 during any stroke of piston 4 until the piston reaches one of its dead-center positions, while simultaneously the fresh gas sucked in during the previous stroke will be compressed within the space decreasing in size within cylinder bores 133, 134 for delivery to inlet ports 2 via possibly valve-controlled outlet ports 153, 155. Once piston 4 has reached either of its dead-center positions, it will be driven back in the opposite direction within the engine under the action of expanding combustion gases; simultaneously, increasing and decreasing spaces will alternate automatically within the compression system, just as inlet ports 152, 154, 156, 158 and outlet ports 151, 153, 155, 157 are correspondingly and alternatingly activated, possibly together with the valves associated with them. In the case of the solution proposed according to claim 34, precompressed air or a precompressed fuel/air mixture will be guided, directly and continuously, from said compressor via inlet ports 2 and orifices 90, 91 thereto connected over the entire piston stroke, which orifices preferably form axially oriented oblong holes, and into hollow piston 4, where it can be accumulated under pretensioning pressure for continuous refilling so that it will invariably be available to flow, directly, in precompressed form, and without any unnecessary loss of tension into combustion chambers 10, 11 whenever bores 20, 21 are opened or unblocked.

I claim:

1. An internal combustion engine, more specifically a free-piston engine, having at least one cylinder (1) comprising one piston (4) therein arranged and guided to be movable and sealed, which piston may perform axial stroke elements within a cylinder chamber (9), and featuring cylindrical projections (7,8) extending axially away from said piston (4) to either side and having at least over part of their length of diameter smaller than the diameter of the piston (4), said projections (7,8) being guided at least over some part of their length within axial cylinder bores (12,13) and therein partially sealed; and having combustion chambers (10,11) within the cylinder (1), said combustion chambers being formed and delimited by certain parts of an inside cylinder wall defining the cylinder chamber (9) and by certain surface parts of the piston (4) and its projections (7,8), the surfaces defining said combustion chambers (10,11) being formed more particularly by end faces (5 and 26, or 6 and 27); and having inlet ports (2) arranged in a longitudinal cylinder wall (100) to admit air, and outlet ports (3) arranged within the longitudinal cylinder wall (100) so as to permit exhaust gases to be expelled, said inlet ports (2) and outlet ports (3) being opened and closed depending upon the axial position of the piston (4) and its projections (7, 8); and having ducts (18,19) within said piston (4) and its projections (7,8), wherein said ducts permit the controlled passage of gases such as air and fuel/air mixtures by forming flow path connections linked to bores (20,21) located in lateral surfaces (101,102) of the projections (7,8), and said ducts may be brought into open flow connection and blocked with respect to said inlet ports (2) depending upon the axial position of said piston (4) and its projections (7,8) relative to the cylinder (1), said ducts may also be brought into open flow connection with said combustion chambers (10,11) via said bores (20,21) and blocked by means of said axial cylinder bores (12,13) at approximately identical axial piston positions relative to said cylinder (1); and wherein said ducts (18 and 19) are arranged separately from each other, one each within one of two longitudinal piston halves (401 and 402) and their respective projection (7 or 8), located to either side of a symmetry plane (K) arranged perpendicularly with respect to the longitudinal axis (A-A) of the piston (4); each of said ducts (18 or 19) being connected with a corresponding orifice (90 or 91) located within a peripheral surface (80) of the piston (4), said orifices (90 or 91) being arranged in an area of radial planes (K1 or K2) located parallel to and at a distance (a) from said symmetry plane (K) of the piston (4); all ports (2) located in the longitudinal cylinder wall (100) being arranged in the area of the symmetry plane (Z) of the cylinder (1); said outlet ports (3) for the combustion chambers (10 or 11) being separate from each other in areas located in radial planes (Z1 or Z2) in parallel to and at a second distance (b) from the symmetry plane (Z) of the cylinder (1); the first distance (a) of the orifices (90 or 91) at either side of the symmetry plane (K) of the piston (4) and the second distance (b) of said outlet ports (3) at either side of the symmetry plane (Z) of the cylinder (1) being defined so that all the inlet ports (2) may be in open flow path connection with the orifices (90 or 91), the ducts (18 or 19), the bores (20 or 21) and the combustion chamber (10 or 11) associated with one of said longitudinal halves (401 or 402) of said piston whenever the end face (6 or 5) of the opposite longitudinal half of the piston (402 or 401) is near the respective end face (27 or 26) of the cylinder chamber (9).

2. Internal combustion engine according to claim 1, wherein the end faces of said projections may act upon a fluid to increase its pressure, wherein said fluid consists of a gas or a hydraulic fluid actuating a system operated by a pressure fluid, which system is directly driven by said internal combustion engine.

3. Internal combustion engine according to claim 1, wherein said combustion chambers (10, 11) both feature toroid-like recesses (83,84) in their end faces (5,6 or 26,27) arranged coaxially with respect to said projections (7,8).

4. Internal combustion engine according to claim 3, wherein said toroid-like recesses (83,84) are formed within the end faces (26,27) of the cylinder chamber (9).

5. Internal combustion engine according to claim 4, wherein said toroid-like recesses (83,84) are formed into the end faces (5,6) of the piston (4).

6. Internal cmbustion engine according to claim 1, having injection nozzles and spark electrodes acting into the combustion chambers and arranged within the cylinder end faces delimiting said combustion chambers, wherein said injection nozzles (28,29) and spark electrodes (128,129) are located in a ring-shaped arrangement surrounding the longitudinal axis (A-A).

7. Internal combustion engine according to claim 3, wherein said injection nozzles (28,29) and spark electrodes (128,129) end at said toroidike recesses (82,84).

8. Internal combustion engine according to claim 1, wherein said bores (20,21) on the periphery of the projections (7,8), and inlet ports (2) on the periphery of the longitudinal cylinder wall (100), and the outlet ports (3) on the periphery of said longitudinal cylinder wall (100) are arranged in a ring-like pattern.

9. Internal combustion engine according to claim 1, wherein in order to control injection and ignition timing, displacement transducers (30,31) are located within said cylinder wall and are arranged with the cylinder (1) in order to capture the axial position of the piston (4).

10. Internal combustion engine according to claim 9, wherein said displacement transducers (30,31) are magnetic field sensors operating electrically and delivering a voltage depending upon the piston position, said voltage, upon processing by electrically operated components, being used to correlate injection and ignition timing with the axial position of the piston (4) within the cylinder (1).

11. Internal combustion engine according to claim 1, wherein within the longitudinal cylinder wall (100), axes of the inlet ports (2) are spaced, relative to the longitudinal axis (A—A), so that a rotational movement around the longitudinal axis (A—A) is superimposed upon the axial travel of the piston (4) and its projections (7,8).

12. Internal combustion engine according to claim 1, wherein said ducts (18,19) are each configured as at least a single individual duct.

13. Internal combustion engine according to claim 12, wherein said ducts (18, 19) are formed to have substantially constant flow crosssections.

14. Internal combustion engine according to claim 1, wherein said projections (7,8) exhibit axially juxtaposed longitudinal sections (121 through 126) formed by cylindrical lateral surfaces, said longitudinal sections having differing diameters relative to adjoining longitudinal sections, so that end faces spaced axially and pointed towards and away from said piston (4) are formed along said projections (7,8) said cylindrical lateral surfaces being movably and slidingly guided within corresponding axial cylinder bores (12 and 13, 133 through 136) of respective diameters and so that suitable sealing means (14,15) are provided between said cylindrical lateral surfaces and the corresponding axial cylinder bores (12 and 13, 133 through 136) therewith associated.

15. Internal combustion engine according to claim 14, wherein said projections (7,8) each have, axially side by side and in a direction away from the piston (4) at least a first longitudinal section (121,122) having a cylindrical lateral surface and a diameter smaller than the diameter of the piston (4) and a second longitudinal section (123,124) having a cylindrical lateral surface the diameter of which is greater than the diameter of said first longitudinal section (121,122).

16. Internal combustion engine according to claim 15, wherein said projections (7,8) each have, axially side by side and in a direction away from said piston (4), three sequential longitudinal sections (121 through 126) each having a cylindrical lateral surface, a diameter of either terminal longitudinal section (125,126) formed at the free end of each of said projections (7,8) being smaller than the diameter of each adjacent longitudinal section 123,124).

17. Internal combustion engine according to claim 1, wherein free ends of said projections are plunged and radially sealed into an axial cylinder bore delimited at an end thereof by a face formed by the cylinder, the plunging depth depending upon axial piston positions without allowing any of free end faces of said projections reach the face terminating said axial cylinder bore so that, within said cylinder bore, a variable-volume chamber is formed between said end faces positioned opposite to each other, the free face of the corresponding projection acting within said variable-volume chamber acting to increase pressure of a given volume of fluid, and wherein valve-controlled supply and removal, controlled via valves of the pressure fluid actuating a system operated by such pressure fluid into and out of said variable-volume chamber within said axial cylinder bores (12,13,135,136) is performed in such a manner that, by the stroke movements of the piston (4) and its projects (7,8), a pressure fluid pump is formed, which pump has two pressure generating chambers and is integrated, together with the internal combustion engine, into said cylinder (1) as a power source actuating the system operated by a pressure fluid.

18. Internal combustion engine according to claim 15, wherein said axial cylinder bores (133,,134) designed to receive two second longitudinal sections (123,124) of the projections (7,8) have an axial length at least sufficient to permit either of said second longitudinal sections (123,124) of the projections (7,8) to perform, depending upon the stroke of the piston (4), an axial stroke as a disk-shaped piston, which stroke is equal to a maximal possible stroke of the piston (4) within the cylinder chamber (9).

19. Internal combustion engine according to claim 18, wherein bores (151 through 158) piercing the wall of the cylinder (1) are provided at the ends of said axial cylinder bores (133, 134) provided for the second longitudinal sections (123,124) of the projections (7,8), which bores (151 through 158) have associated with them controlling valves, some of said bores (151,153,155 and 157) serving as outlets and some of said bores (152,154,156 and a58) serving as inlets for a fluid, and each pair of one inlet and one outlet bore (151,152 or 153,154 or 155,156 or 157, 158) extending perpendicularly into the cylinder bores (133,134) of said second longitudinal sections (123,124) and being assigned to one variable-volume chamber formed within the cylinder bores (133,134), said one chamber being hermetically sealed with respect to chambers formed within the cylinder (1) for other pairs of the inlet bores and the outlet bores, each of said cylinder bores (133,134) being subdivided into two axially adjacent chambers of negatively correlated, variable capacity by said second longitudinal sections (123,124) forming separating, disk-shaped pistons.

20. Internal combustion engine according to claim 19, wherein supply and removal of pressure fluid to and from said variable-volume chamber within axially outermost cylinder bores (12,13 or 135,136) is caused by said end faces (87,88) formed by the cylinder (1), the controlling valves (22,23,24 and 25) for controlling said supply and removal of pressure fluid being integrated into said end faces (87,88) of the cylinder wall.

21. Internal combustion engine according to claim, 20 wherein pressure fluid has a subsidiary function of cooling the cylinder (1) in the area of walls around the cylinder chamber (9).

22. Internal chamber engine according to claim 21, wherein pressure fluid is fed, at low pressure into the cylinder (1) on its suction sides at both ends of said cylinder (1), said pressure fluid being led at either end face area of the cylinder (1) to pressure fluid ducts (81,82), said ducts being large-surface ducts and each axially running towards an opposite end of the cylinder through the longitudinal cylinder wall (100), at which opposite ends said pressure fluid may enter, under valve control, via bores and valves into axially outermost variable-volume chambers located within the terminal cylinder bores (12,13 or 135,136) and the pressure fluid may leave, at increased pressure, the variable-volume chambers located within the outermost cylinder bores (12,13 or 135,136) via a corresponding outlet valve (22,24) and exit from the cylinder (1) in a directly axial direction at the same end face of the cylinder via one of the outlets (85 or 86).

23. Internal combustion engine according to claim 22, wherein the end faces (87,86) formed by the cylinder wall are formed of at least two wall areas located parallel to each other and consisting of sealed cylinder wall components arranged adjacent to each other, and wherein an exterior terminal wall area comprises pressure fluid connections leading to a system operated by said pressure fluid and an adjacent wall area parallel to the exterior terminal wall area but located axially further towards an interior to transfer suction-side supplies into the pressure fluid ducts (81,82) comprising an inlet valve (23,24) and to direct suction-side supplies arriving from another end of the cylinder through the pressure fluid ducts (81,82) via the corresponding inlet valve (23,25) into the axially exterior, variable-volume chamber of the corresponding cylinder bore (12,13 or 135,136).

24. Internal combustion engine according to claim 1 wherein precompressed air and fuel/air mixture are supplied to the internal combustion engine via a separate compressor unit (50) through the inlet ports (2).

25. Internal combustion engine according to claim 23, wherein the end faces of said projections alternatingly act to compress a temporarily enclosed volume of air before said air is supplied to the corresponding combustion chamber of said internal combustion engine, and wherein any air and fuel/air mixture intended to fill the combustion chambers (10,11) of said engine through inlet ports (152,154,156,158) may be introduced into the corresponding axial cylinder bore (133 or 134) of the second longitudinal section (123 or 124) of the corresponding projection (7 or 8) for precompression, within one of said cylinder bores (133 or 134), by the stroke of one of said second longitudinal sections (123 or 124) depending upon the movements of the piston (4), and for transfer to the inlet ports (2) via the outlet ports (151,153,155,157) and connecting ducts.

26. Internal combustion engine according to claim 23, the piston acting to precompress air and fuel/air mixture via the end faces of its projections, the precompressed fluid being supplied to the combustion chambers via ducts within the piston, and wherein at least two variable-volume chambers within the cylinder bores (133,134) of said second longitudinal sections (123,124) of the projections (7,8) are used for precompression purposes, and their outlet ports (151, 153,155,157) may be in connection with the inlet ports (2) within the longitudinal cylinder wall (100).

27. Internal combustion engine according to claim 26, wherein during any stroke of the piston (4) and said second longitudinal section (123 or 124) of each of the projections (7,8), two outlet ports (151 and 157 or 153 and 155) located at either side of the symmetry plane (Z) and assigned to the corresponding variable-volume chamber of the cylinder bores (133 or 134) are reduced in size and are jointly linked to the corresponding inlet ports (2).

28. Internal combustion engine according to claim 19, wherein control valves are assigned to said bores (151 through 158), which valves are built into said bores (151 through 158), at least some of the valves assigned to the bores (151 through 158) being used for a control of the volume of gas filling the corresponding combustion chamber, and said control valves being fitted with an exhaust air connection and automatic control means.

29. Internal combustion engine according to claim 25, wherein a corresponding, axially outermost variable-volume chamber within the respective cylinder bore (133 or 134) is used to increase the pressure of pressure fluid actuating a system operated by such pressure fluid, said outermost chamber being linked up to pressure fluid connections (81,82,85,86) and valves (22 through 25), and axially outermost free end face at each of the projections (7,8) simultaneously constituting a large-size end face of said second longitudinal section (123 or 124), acting to increase pressure of said fluid contained within the corresponding outermost chamber, while a smaller end of said second longitudinal section (123, or 124) facing the piston (4) is used, within an adjacent, negatively-correlated variable-volume chamber formed within said axial cylinder bore (133 or 134), to precompress the air and the fuel/air mixture to be fed into said combustion chambers (10, 11).

30. Internal combustion engine according to claim 18, wherein said axially terminal cylinder bores are used to precompress air and fuel/air mixture intended to fill the combustion chambers of the engine, and wherein said axial cylinder bore (133 or 134) is configured to be fitted with valve-controlled pressure-fluid inlets and outlets, and constitutes, together with said second, larger-diameter longitudinal section (123 or 124) of the corresponding projection (7,8) an alternating piston pump for a system operated by pressure fluid.

31. Internal combustion engine according to claim 2, wherein said internal combustion engine (33) is used, within a system actuated by a hydraulic pressure fluid, together with a hydraulic drive unit (46) switchable from a motor to a pump operation and vice-versa, said drive unit (46) being coupled to an electrically driven unit (47) switchable from a starter to a dynamo operation and viceversa, and including a battery (48), said unit, in order to crank the internal combustion engine (33), may be switched to its starter operation, and in its dynamo operation (45) linked up to a hydraulic motor (36) and an accumulator (40).

32. Internal combustion engine according to claim 1, wherein said piston (4) is configured as a free piston without any direct mechanical driving link in the form of a directly articulated connection to mechanical transmission members.

33. Internal combustion engine according to claim 1, said engine having a direct mechanical drive connection acting axially via an articulated, directly linked mechanical transmission member, wherein said internal combustion engine has axial, mechanical driving links at either side thereof via articulated mechanical transmission members.

* * * * *